United States Patent [19]

Mierke et al.

[11] 4,000,598

[45] Jan. 4, 1977

[54] SHEAR TOPPER FOR PACKING VEGETABLES

[75] Inventors: Ralph Carl Mierke; Joseph James Busco, both of Lyons, N.Y.

[73] Assignee: Borden, Inc., Columbus, Ohio

[22] Filed: Aug. 21, 1975

[21] Appl. No.: 606,390

[52] U.S. Cl. ..... 53/123; 83/140; 141/80

[51] Int. Cl.[2] ..... B65B 63/00

[58] Field of Search ..... 53/23, 123; 141/80; 83/140

[56] References Cited

UNITED STATES PATENTS

| | | | |
|---|---|---|---|
| 1,696,796 | 12/1928 | Fink | 141/80 |
| 2,444,502 | 7/1948 | Fromer | 53/123 X |
| 2,492,826 | 12/1949 | Ardron | 53/123 X |
| 2,795,908 | 6/1957 | Christiansen | 53/123 X |
| 3,283,630 | 11/1966 | Domka | 83/140 X |

*Primary Examiner*—Travis S. McGehee
*Attorney, Agent, or Firm*—George P. Maskas; Daniel D. Mast; George A. Kap

[57] ABSTRACT

An improved apparatus for canning elongated, limp materials such as string beans or asparagus that includes a means for cutting the beans while in the can and means for adjusting the liquid in the head space of a can to a uniform and desired level. The improved process averts a separate clamping and cutting step formerly required in canning processes.

3 Claims, 5 Drawing Figures

SHEAR TOPPER FOR PACKING VEGETABLES

This invention relates to an improved process for canning elongated, limp material such as string beans and to an improved apparatus that can be used to modify existing canning machines.

BACKGROUND OF THE INVENTION

In the past, many attempts have been made to provide an apparatus and a process for filling cans with a "hard to pack" material such as string beans or other elongated, limp vegetable. A number of patents have been issued, including the following:

Greco (U.S. Pat. No. 1,235,680) which shows shearing knives for cutting off the ends of beans protruding from the mold prior to pushing them in a can.

Gardner, et al (U.S. Pat. No. 2,048,156) which relates to a machine for bunching, cutting and canning "Vienna" type sausages.

Taylor (U.S. Pat. No. 2,092,786) which relates to a machine for canning pineapples.

deBack (U.S. Pat. No. 2,190,936) related to a process of packing carrots or corn on the cob (tapered articles). This patent shows knives for cutting off the extending ends of the cob and shows a plunger for pushing the corn from the mold into a can.

Thompson (U.S. Pat. No. 2,467,278) covers a turret machine for arranging, cutting and canning string beans. The beans are arranged and cut and then inserted into the can.

Christensen et al (U.S. Pat. No. 2,769,291) which relates to canning beans or asparagus. In this apparatus a closure box holds the beans, the beans are cut, and then a plunger forces the beans into a can.

None of these patents show shearing the beans, or other similar vegetable, while they are already in the can. Instead, they show placing the beans in a mold or some other closure, shearing the ends of the beans, and then inserting the cut beans into a can.

SUMMARY OF THE INVENTION

It is an object of this invention to provide an improved process for filling cans with elongated materials such as string beans, asparagus and the like.

It is a further object to provide a device for cutting the beans and causing them to fit and completely fill the can.

Its is an object to provide a process that expeditiously fills the cans with a vegetable that's difficult to pack, like string beans.

It is an object to provide an apparatus that cuts and fits the beans, completely fills the cans, and properly adjusts the water in the head space of the can.

The objects of the invention are obtained with the apparatus and process of this invention which completely eliminates the need for clamping the elongated material and cutting to length in a step separate from filling the cans. In the present invention, the string beans are introduced into the can so that the can is completely filled. The ends of the beans are then cut while in the can and finally, after the liquid in the head space is adjusted to a uniform level, the can lid is applied to the can in a conventional manner.

The invention will be better understood by reference to the drawings in which.

Figure 1:
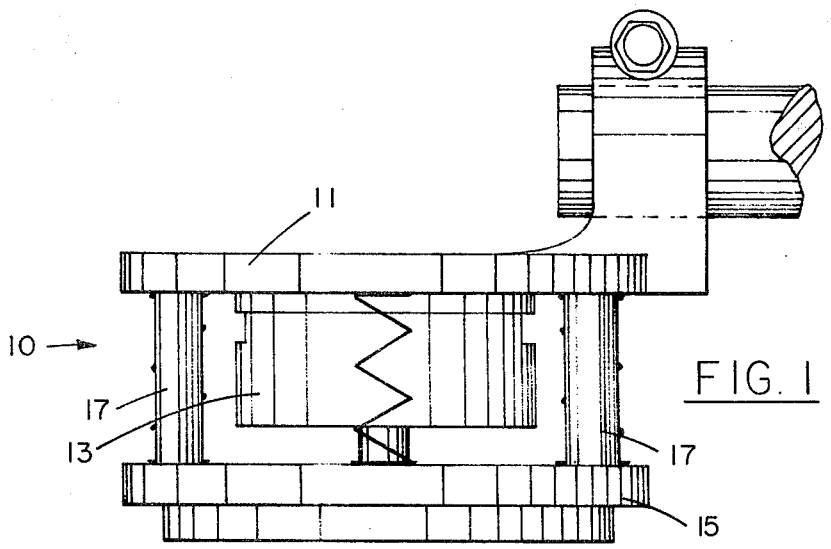
FIG. 1 is a view in elevation of the apparatus used to carry out this invention.
Figure 5:
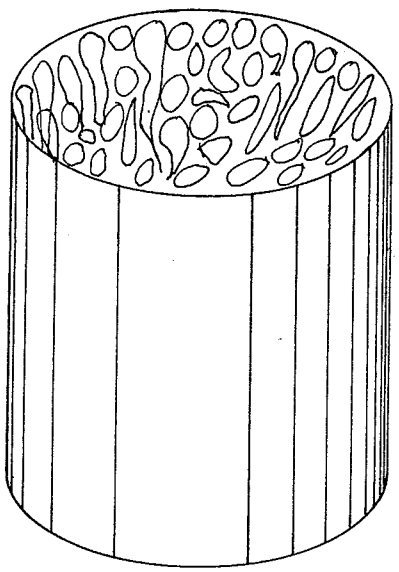
FIG. 5 is a view of the can with the beans cut and ready for the can lid to be applied.
Figure 4:
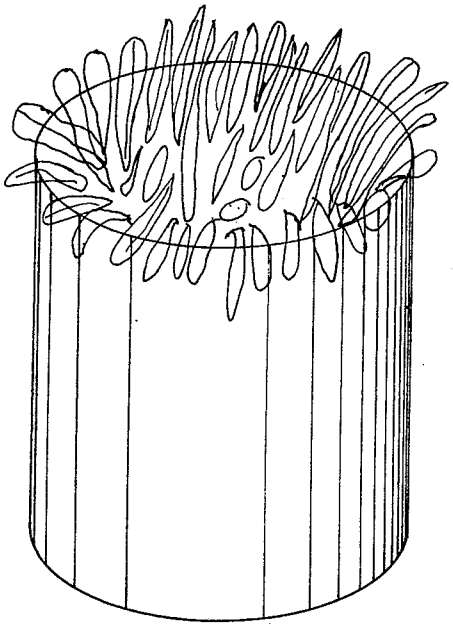
FIG. 4 depicts a can with beans uncut, some of the beans extending outside and over the top of the can.
Figure 3:
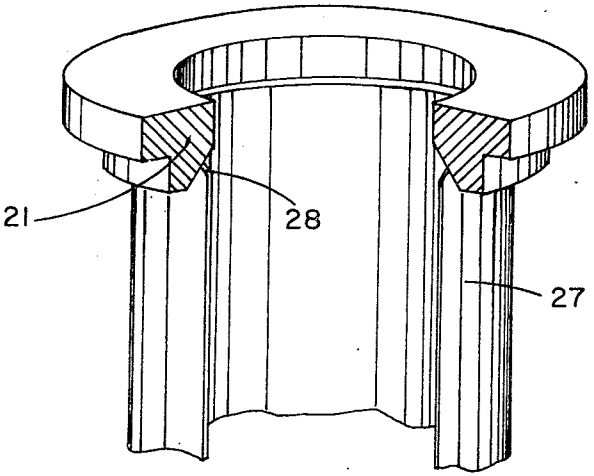
FIG. 3 is a perspective view partly in section showing the shearing ring of the apparatus.

In FIG. 1, a shear topper 10 is shown with all parts assembled and comprising the following:

Pad 11
Spacer 12
Plunger 13
Screws 14, 14
Shearing ring 15
Springs 16, 16
Shoulder screws 17,17

Figure 2:
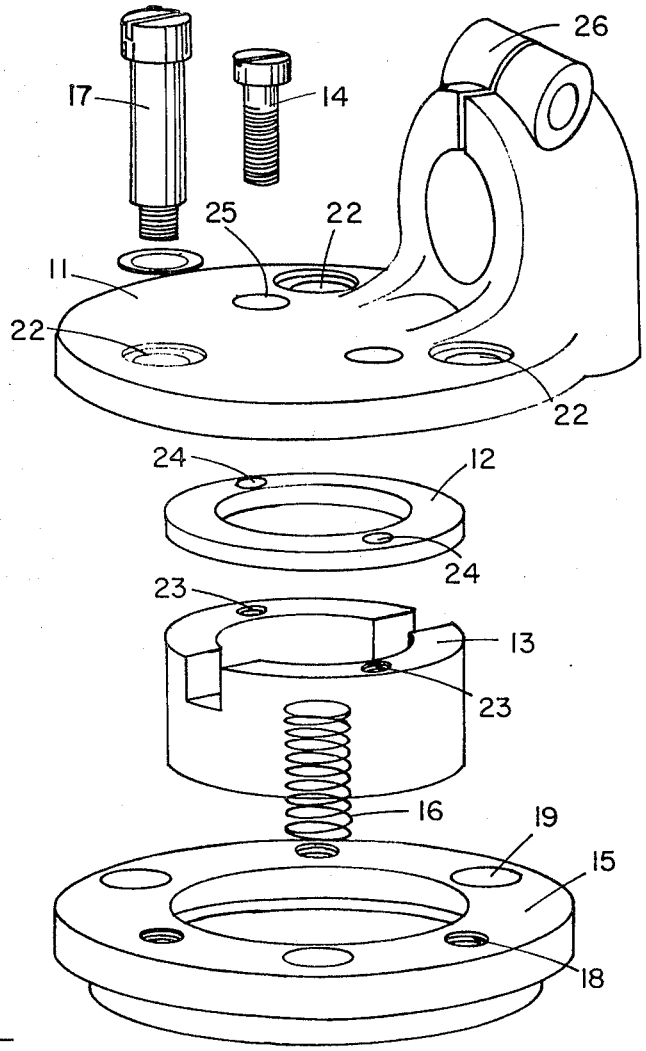
FIG. 2 is an exploded view in perspective of this same apparatus.

In assembling this shear topper 10 (see FIG. 2), the plunger 13 and spacer 12 are secured to the pad 11 using two screws 14, 14 that are inserted through holes 25, 25 in the pad and thence through the holes 24, 24 in the spacer and finally into the tapped holes 23, 23 of plunger 13. Spacers having a greater or smaller thickness than the one shown may be utilized for adjusting the depth of the plunger travel into the can to be filled and topped.

The shearing ring 15 with springs 16, 16 already in place in the recessed holes 19, 19 of the shearing ring is brought up into position around the plunger and below the pad so that the three shoulder screws 17, 17 can be directed through holes 22, 22 of the pad and into tapped holes 18, 18 of the shearing ring 15.

These shear toppers are used on a conventional threehead paddle packer as follows:

The shear toppers 10, 10 are installed on a threehead paddle packer which is driven and timed by a canner closing machine (not shown). The shear toppers are adjusted so that the proper height is obtained to assure (1) proper shearing action by the shearing ring 15 and (2) proper packing by the plunger 13 to achieve packing of the product, proper head space, and discharge of excess water. The shear topper is vertically adjusted so that the shearing ring operates properly in conjunction with the top flange of the can to cut off any protruding beans. In addition the height is adjusted so that the plunger packs the product and adjusts the liquid in the head space to the desired level. It is possible to adjust the height of the shear topper 10 so that proper pressure is exerted between the shearing ring and the flange of the can without damaging the can itself. The three springs 16, 16 inserted between the shearing ring and the pad allow the shearing ring to move toward the pad when the shearing ring contacts the can and at the same time the springs exert the desired force downwardly on the shearing ring so that the tapered surface 21 of the shearing ring acts cooperatively with the can flange to provide the necessary cutting action. The three shoulder screws 17, 17 allow movement of the shearing ring and yet keep the shearing ring and pad in the proper relative position so that the device can operate properly.

In operating the apparatus shown in the drawings, cans are moved on a conveyor into a filling zone. After the can is filled with beans, it advances to a topping zone. In this zone the shear topper 10 moves downwardly until it bears upon the top flange of the can 27 and the beans are cut off by contact of tapered surface 21 of the shearing ring with can flange 28 of can 27. At the same time plunger 13 is inserted into the can 27 so that the beans in the can are packed downwardly and the liquid at the top of the can passes through the center vent of the plunger and is thereby removed from the head space of the can. After the shear topper is moved upwardly, the can then proceeds to the closing machine which places and secures the lid of the can to the can in a conventional manner.

The advantages of this process and apparatus are centered around the elimination of the separate step of molding, clamping or otherwise holding the beans and then cutting them off prior to insertion of the beans in the can. This simple device, which has been shown in the drawings, very effectively cuts and packs vegetables such as string beans. There is no need for sharpening of knives or for that matter even providing knives since the flange of the can is used as the knife, and the tapered surface of the shearing ring lasts indefinitely. It has been found that the device requires very little maintenance and continues to run effectively for great lengths of time with no attention from the operator of the machine.

Although the invention has been described in detail with respect to canning beans, it should be evident that the device can be used for packaging other similar materials and the invention is not intended to be limited to the specific embodiment shown but rather is to include obvious variations and modifications within the spirit and scope of the following claims.

We claim:

1. A device for packing elongated material in a can including a generally horizontal pad member, secured to the bottom of the pad member a generally cylindrical plunger suitable for insertion into the open end of a can, the plunger and a height-adjusting spacer being secured to the pad by suitable screws, said plunger having a vent opening to allow passage of liquid and gas therethrough, and concentric with and surrounding said plunger and on the underside of said horizontal pad member a cylindrical shearing ring spring mounted to the horizontal pad member, said shearing ring being adapted for cooperatively engaging the top flange of a open-end can to provide a cutting action when the pad member and the attached shearing ring is lowered.

2. In a container filling device that fills a can with elongated, limp material such as string beans in a filling zone and then caps the can in a capping zone, a shear topper positioned between the filling and capping zones for cutting the elongated material while in the open can and prior to capping of the can, the shear topper, including a generally horizontal pad member movable vertically to approach the top surface of a filled but uncapped can, mounted on the underside of said pad member a cylindrical plunger having a diameter just less than the inside diameter of the can, said plunger having a vent hole for the escape of excess liquid and gas from the head space of the filled can when the plunger is inserted into the can, and concentric with and generally surrounding said plunger, a shearing ring spring-mounted to said pad member, said shearing ring having a can-engaging surface that tapers upwardly and inwardly from the bottom of said shearing ring to the innermost surface of said ring, and adapted for engagement with the top of a can to provide a downward shearing action only therewith.

3. In combination, supporting means for a filled and open-top container, a shear and topping device for elongated, limp material such as string beans disposed above said supporting means and capable of movement up and down to bear upon an upper flange of an open-top container on said supporting means and to exert sufficient force on said flange of the can to cut any said limp material that may be over the flange of the can, said shear and topping device including a generally horizontal pad member having a mounting means for securing said pad to a can closing machine, disposed below said pad and secured to said pad in a spaced-apart manner by a spacer and screw means a plunger having a vent opening which in conjunction with said spacer defines a path for flow of excess fluid from said container, and concentric with and surrounding said plunger and on the underside of said horizontal pad a shearing ring spring mounted to said horinzontal pad member to provide a downward cutting action bearing against the upper flange of said container sufficient to cut said limp material and yet not damage said upper flange, and spring and screw means for securing said shearing ring to said horizontal pad.

* * * * *